US005365989A

United States Patent [19]

Eger et al.

[11] Patent Number: 5,365,989

[45] Date of Patent: Nov. 22, 1994

[54] AWNING HAVING A CONVEX DROP BLADE WHICH FITS ON AN AWNING CASE WHEN THE AWNING IS ROLLED-UP

[75] Inventors: Heinz Eger, Bissingen-Ochsenwang; Alfred Bodentien, Kirchheim-Otlingen, both of Germany

[73] Assignee: MHZ Sonnenschutztechnik GmbH, Kirchheim/Teck, Germany

[21] Appl. No.: 36,428

[22] Filed: Mar. 24, 1993

[30] Foreign Application Priority Data

Mar. 27, 1992 [DE] Germany ..... 4209972

[51] Int. Cl.[5] ..... E04F 10/06

[52] U.S. Cl. ..... 160/22; 160/70

[58] Field of Search ..... 160/22, 66, 23.1, 68, 160/69, 70; 135/89

[56] References Cited

U.S. PATENT DOCUMENTS

| | | | |
|---|---|---|---|
| 1,833,688 | 11/1931 | Nelson et al. | 160/22 |
| 3,991,805 | 11/1976 | Clauss | 160/22 |
| 4,020,888 | 5/1977 | Upton et al. | 160/66 |
| 4,469,159 | 9/1984 | Lohausen | 160/22 |
| 4,566,516 | 1/1986 | Lohausen | 160/22 |
| 4,615,371 | 10/1986 | Clauss | 160/22 |

FOREIGN PATENT DOCUMENTS

| | | |
|---|---|---|
| 1194951 | 9/1986 | European Pat. Off. . |
| 2331365 | 1/1975 | Germany . |
| 7510762 | 4/1975 | Germany . |
| 2514941 | 10/1976 | Germany . |
| 2635287 | 2/1978 | Germany . |
| 2514941C3 | 12/1978 | Germany . |
| 2806577 | 8/1979 | Germany . |
| 3804150C2 | 8/1989 | Germany . |

*Primary Examiner*—David M. Purol

*Attorney, Agent, or Firm*—Frishauf, Holtz, Goodman & Woodward

[57] ABSTRACT

The awning has an awning case (2) of sheet metal having a wider slot (11) extending father upward, compared to conventional awnings. The upper and lower edges (12, 13) of the slot are beaded. A drop-blade (8) having a similar curvature as the case, and also made of sheet metal, in rolled-up state of the awning fits closely over the slot (11) with an overlap at top and bottom. Wall brackets (5) are constructed in form of several interfitting parts and provided with a hinge connected on one end to articulated arms (9, 32, 33). The other ends of the arms are hinged to holders suspended from the drop-blade (8). When the awning is rolled-up the arms fold unobtrusively below the awning case. In the rolled-up condition the awning looks like a closed cylinder. A sealing element (83) prevents water from getting into the awning case.

20 Claims, 4 Drawing Sheets

AWNING HAVING A CONVEX DROP BLADE WHICH FITS ON AN AWNING CASE WHEN THE AWNING IS ROLLED-UP

FIELD OF THE INVENTION

This invention concerns an awning having an awning case which has a cloth-feed slot extending over approximately the length of the awning case, a roll-up shaft held in bearings at ends of the awning case, an awning cloth having one end attached to the roll-up shaft and fastened across its width at the other end to a rigid drop member extending across its width position on a building wall, and articulated arms hinged on the brackets and on the drop member, swingable about parallel hinge-pin axes.

BACKGROUND

An awning of the above mentioned kind is known from U.S. Pat. No. 3,991,805, Clauss, to which German published patent application 25 14 941 corresponds. It has a generally tubular awning case which is closed at its ends. Bearings are located in end pieces of the awning case in which a roll-up shaft of the awning is rotatably mounted. The mounting of the awning case on the facade of a building is provided by two hoop-like wall brackets which surround about 270° of the circumference of the awning case. The brackets also provide hinges for articulated arms at the ends that remain near the wall. At the other ends these arms are hinged to the drop member.

In awnings heretofore known, the cloth-feed slot of the awning case is more or less symmetrical with respect to a plane which contains the axis of the roll-up shaft and along which the awning cloth extends out in the spread-out state of the awning. The upper edge of the cloth-feed slot is relatively close to that plane. In consequence, when the awning cloth unrolls downwardly, it continually ribs the upper edge of the cloth feed slot or is deflected by that edge.

In order to prevent any portion of the awning cloth, when the awning is rolled-up, to be exposed to weather without protection and to prevent from dripping onto the water cloth from the awning case, the drop-rod in the above mentioned prior art awning is provided with a protruding flange directed towards the awning case and which is engaged under the upper edge of the cloth-feed slot when the awning is rolled-up. In that state the articulated arms are folded together and located between the lower part of the drop-rod and the awning case. In consequence, in the rolled-up state of the awning, the drop-rod projects distinctly from the outer contour of the awning case.

SUMMARY OF THE INVENTION

It is an object of the present invention to provide an awning in which, in the rolled-up state, the outline of the drop member will not stand out so strongly, if at all, from the shape of the awning case.

Briefly the awning case has a cylindrical outer shape; the drop member is a drop-blade having an outer side of circular arc cross section and it convexly covers the cloth-feed slot, overlapping a lengthwise strip of the awning case on each side of the cloth feed slot when the awning is rolled-up. The folded articulated arms are then located substantially beneath the awning case.

Because of its shape the drop-blade can fit close to the similarly shaped generally cylindrical awning case. It no longer stands out appreciably from the shape of the awning case. At the same time the overlap of strip-like regions on each side of the cloth feed slot enables the drop-blade to seal off the inside of the awning case. There is practically no risk of rain water getting into the awning case and spoiling the awning cloth.

The new configuration just mentioned makes it possible to shift the cloth-feed slot farther upwards than is possible for awnings in which the drop-member grips under the edge of the cloth-feed slot. The higher position of the cloth-feed slot makes it possible for the awning cloth to run freely in and out of the slot, thus avoiding any scouring of the awning cloth at the upper edge of the cloth-feed slot. In consequence, the force needed for rolling up or unrolling the awning is reduced and the useful life of the awning cloth is extended.

It is furthermore possible, in the awning of the invention, to separate the edges of the cloth-feed slot so far that any risk of rubbing of the awning cloth at the lower edge of the cloth-feed slot is avoided.

A particularly suitable shape for the rolled-up awning is provided if the radius of curvature of the outer shape of the drop-blade is grater than the radius of curvature of the awning case, and particularly if the respective centers of curvature of the drop-blade and of the awning case fall on the axis of the roll-up shaft.

Surprisingly, the stiffness is entirely sufficient when the exterior of the awning case is cylindrically smooth and has no longitudinally running corrugations, even though the weight of the cloth wound up on the roll-up shaft is supported exclusively by the end caps of the awning case and the weight is transmitted through the awning case to the wall brackets.

Bucket-like caps can be used for the end covers of the awning case which have an outer diameter twice as great as the radius of curvature of the outer shape of the drop-blade, so that the drop-blade is flush with the edge of the bucket-like caps when the awning is rolled-up.

The manufacture of the awning case and the drop-blade is quite simple if either or both of them are made by shaped sheet metal.

BRIEF DESCRIPTION OF THE DRAWINGS

The invention is further described with reference to an illustrative example with reference to the annexed drawings, in which.

DESCRIPTION OF THE PREFERRED EMBODIMENT

Figure 1A:
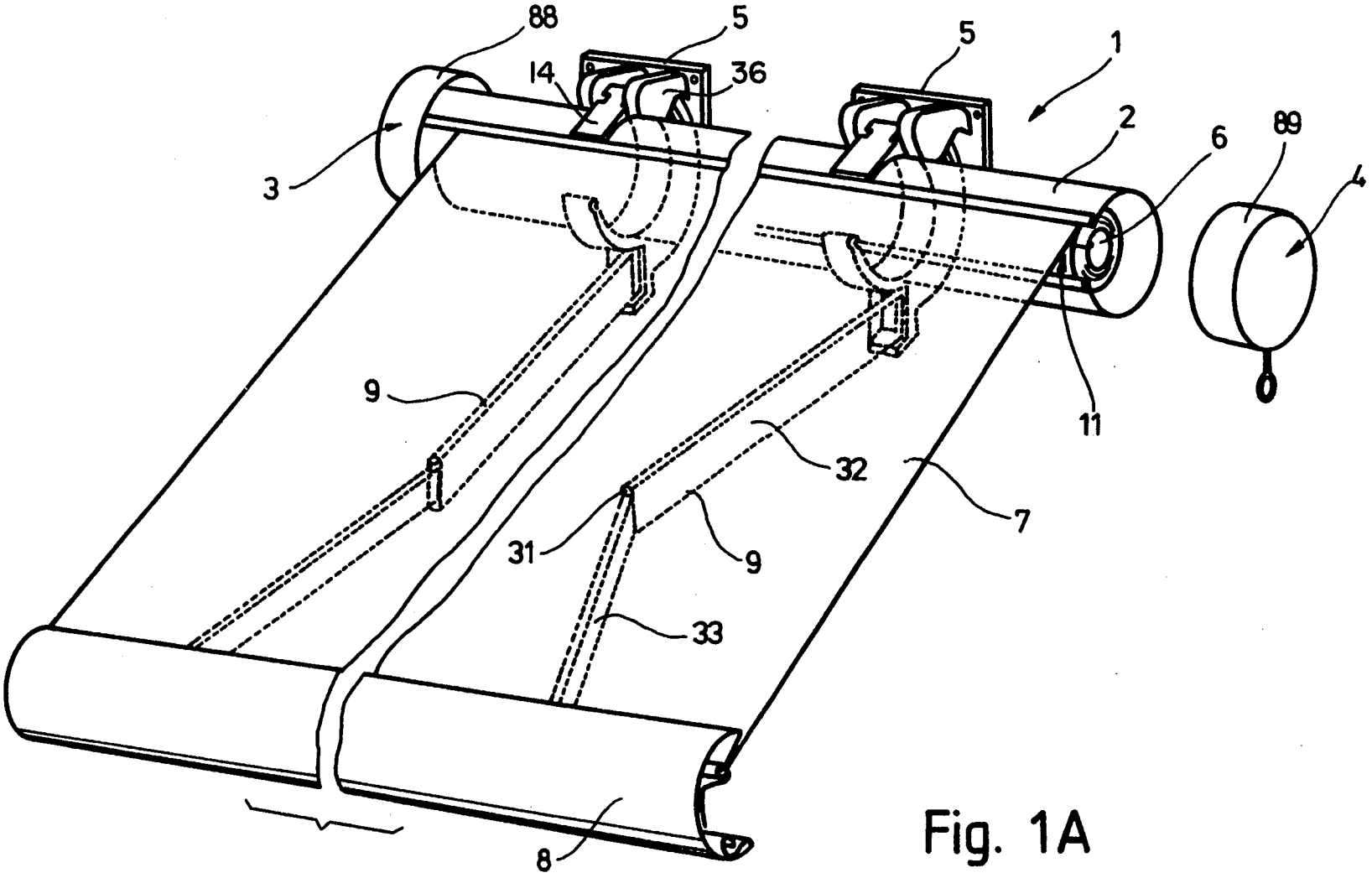
FIG. 1A is a perspective view of the awning of the invention, with the center portion broken away to enlarge the scale of the representation of the remainder.

FIG. 1A shows, less than fully spread out, an articulated awning 1 having a cylindrical tubular awning case 2 which is closed off at the ends by respective cover caps 3 and 4. The awning case 2 is affixed to a wall or facade of a building (not shown) by means of two wall brackets 5 which correspond to each other as mirror images. Inside the awning case 2 a winding shaft 6 is disposed which is rotatably seated in bearings (not shown) of the caps 3 and 4. The end cap 4 also contains a worm-gear drive (not shown), having a driving eye 4a (FIG. 1B) to which a downward leading crankshaft (not shown) can be hooked on or otherwise connected so as to provide a driving crank (not shown) at a suitable location, for rotating the shaft 6 in the awning case 2 and thereby letting out or rolling up the awning cloth 7. The awning cloth 7 is fastened to the roll-up shaft 6. At its outer edge the awning cloth 7 is attached to a drop-blade 8. Articulated arms 9 are hinged on holders (not visible in FIG. 1A) suspended from the drop-blade 8 at one end and at the other end they are held in corresponding hinges of the two wall brackets 5.

Figure 2:
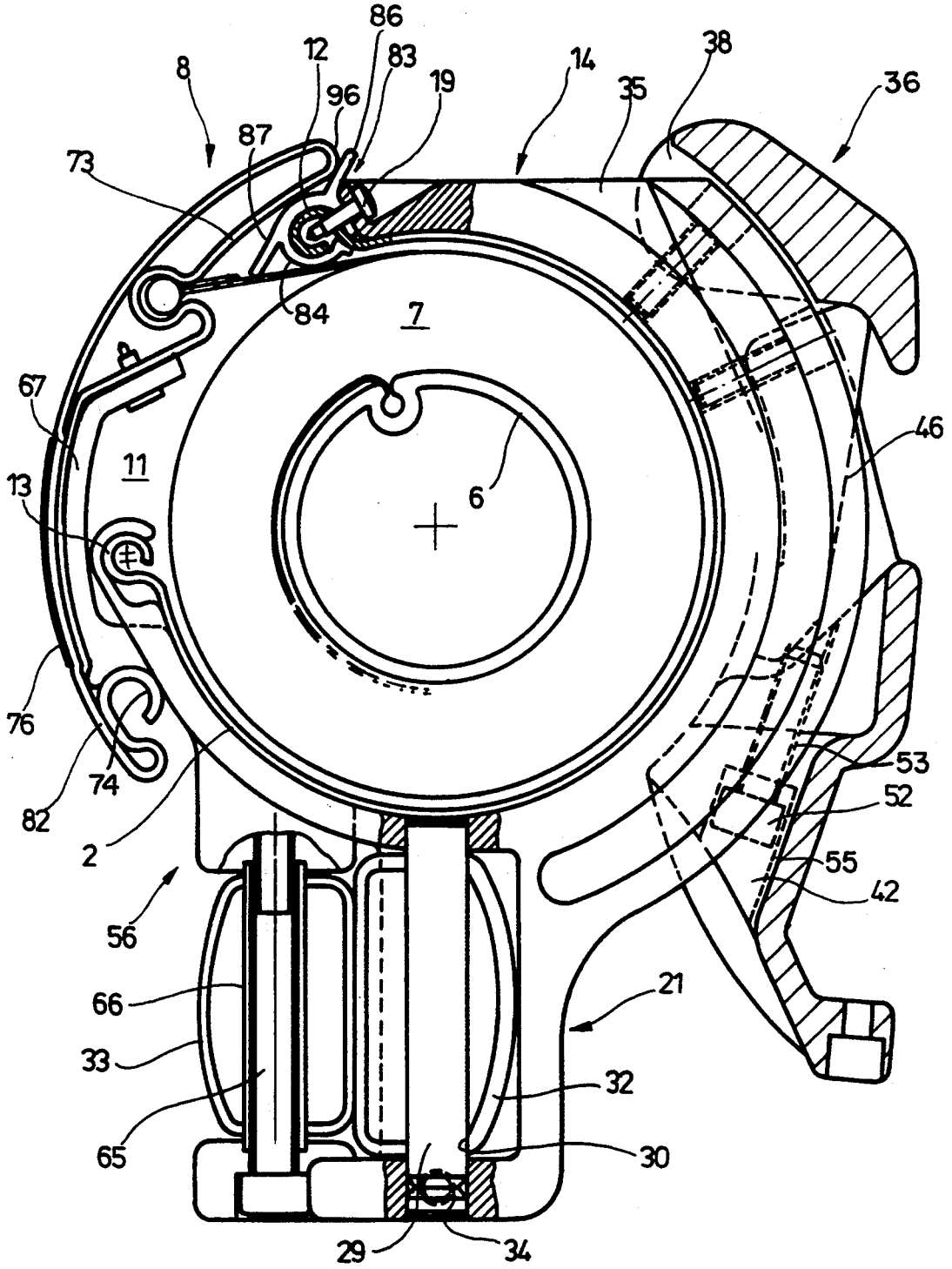
FIG. 2 is a cross-section through the awning of FIGS. 1A and 1B in its rolled-up state, the section being in the region of one of the hoop-like wall brackets.
Figure 3:
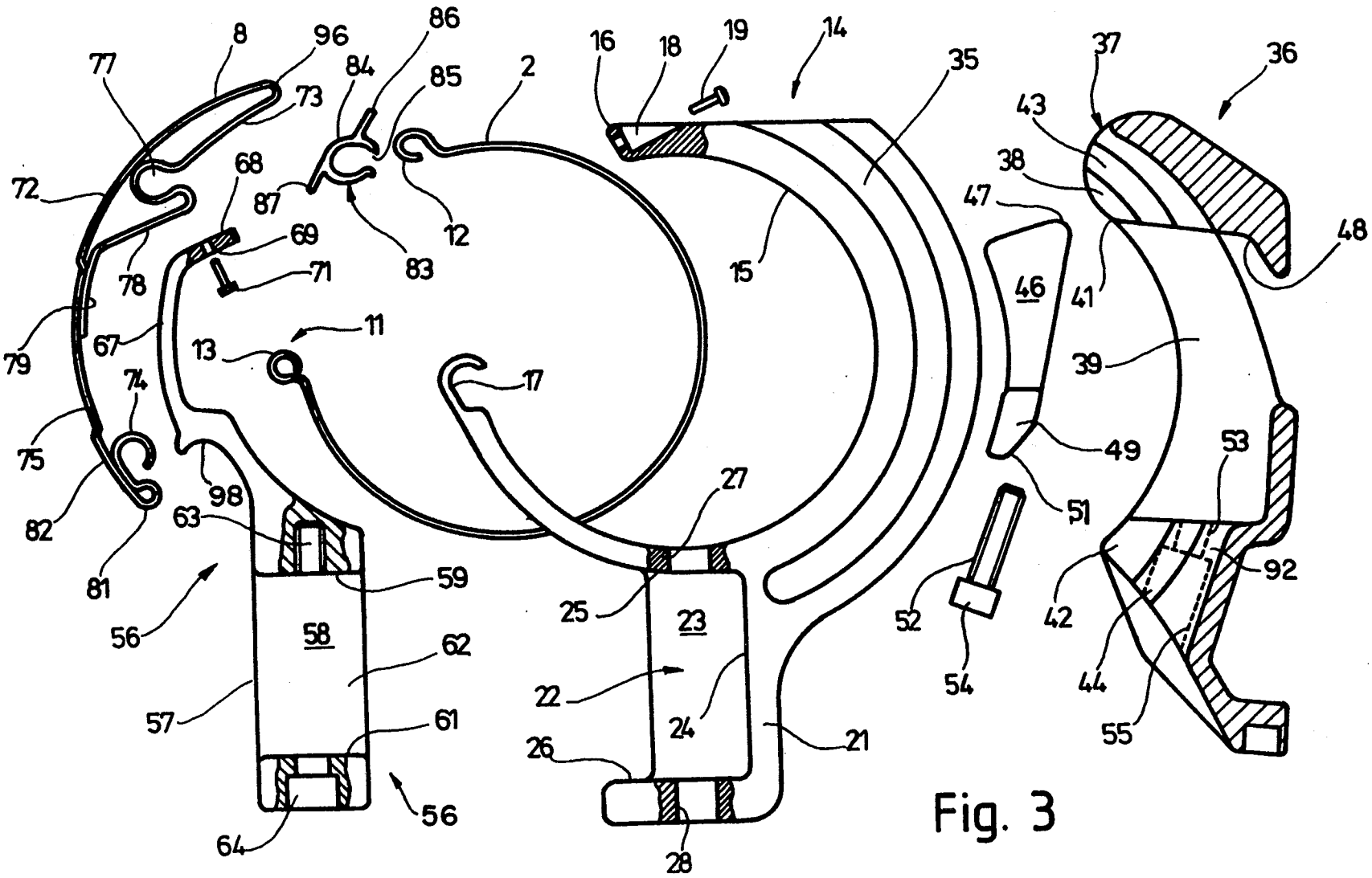
FIG. 3 is an exploded representation of the parts shown in FIG. 2 for the awning of FIGS. 1A and 1B, with omission of the roll-up shaft and of the articulated arms.

As shown in both FIGS. 2 and 3, the awning case 2 consists of a shaped sheet metal part that has a cylindrical outside shape. That sheet metal part is not, however, closed tight around its circumference, but has a cloth slot 11 bounded by two bead-like edges 12 and 13 which extend over the entire length of the awning case 2. In the region of these bead-like edges, the sheet metal is rolled inwards, as shown in FIG. 3, or else the edges are correspondingly thickened, so that there will be no outwardly exposed sharp sheet metal edges. The inner diameter of the awning case 2 is greater than the maximum diameter of the cloth rolled-up on the winding shaft 6 and the arrangement is disposed so that the axis or the center of curvature of the awning case 2 coincides with the longitudinal rotation axis of the roll-up shaft 6.

Since the two wall brackets 5 have a mutually identical shape (in mirror image), the following description relates to only one of the two wall brackets; the explanation holds in similar fashion for the other wall bracket, which is therefore not further described in what follows.

The wall bracket 5 has a separable outer bracket 14 which has an interior C-shaped surface corresponding to the outer diameter of the awning case 2. That surface is shown at 15 in FIG. 3. Within that surface 15 the awning case 2 is seated in such a way that the awning cloth slot 11 is not obstructed by the outer holding bracket 14.

In the assembled state the bracket 14 has its upper free end against the outwardly directed rear side of the upper bead-like edge 12 of the awning case, and, from that place, follows the 25 outer contour of the awning case 2. The lower bead-like rolled edge 13 rests in a cavity 17 of a hook-shaped lower end of the outer holding bracket 14 (FIG. 3). The hook-shaped end of the bracket 14 is open towards the inside of the bracket.

In order to secure the bracket 14 in the axial direction on the awning case 2, the bracket 14 has, at its upper end 16, an oblique step-profiled cavity 18 from which a fastening, for example a self tapping screw 19, can be screwed into the upper bead-like edge 12 and passing through a bore accessible from the cavity 18.

Beneath its upper end 16 the bracket 14 has an extension 21 (FIG. 3) which is located more or less diametrically opposite the upper end 16 with respect to the axis of the winding shaft 6. The extension 21 contains a pocket-like cavity 22 which is bounded by walls 23 and 24 which are also integral with the bracket 14. At their upper and lower ends the walls 23 and 24 blend into upper and lower surfaces 25 and 26. Two aligned bores 27 and 28 are provided in the respective surfaces 25 and 26. Into these bores a cylindrical hinge pin 29 is placed as is shown in FIG. 2.

Figure 1B:
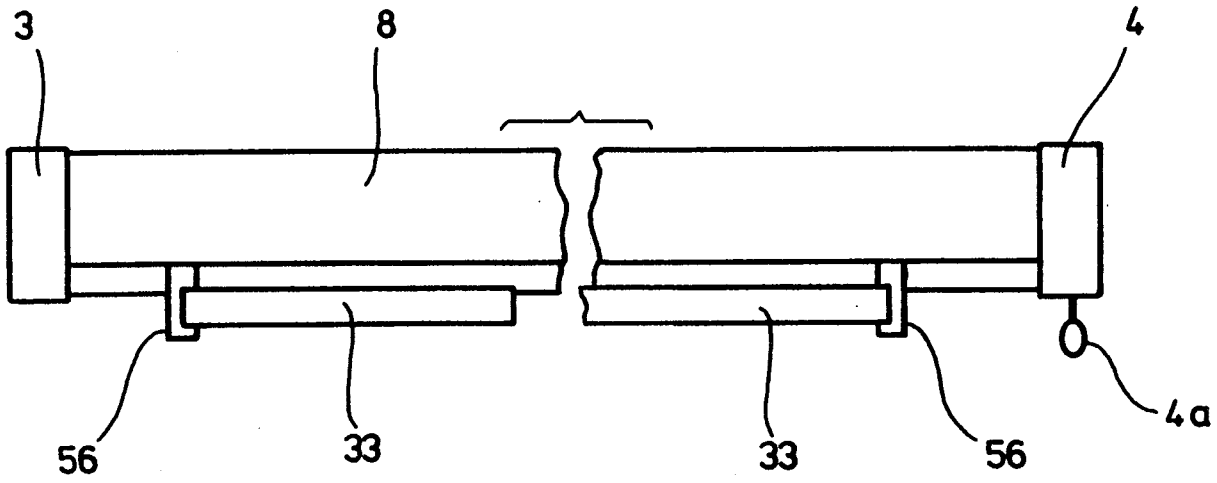
FIG. 1B is a front elevation view of the awning in the rolled-up state.

The extension 21 forms the wall-side portion of a hinge by which the articulated arm 9 is hinged. The articulated arm 9 consists of two arm portions 32 and 33 connected together by a hinge 31 that permits the portions 32 and 33 to fold flat together (FIG. 1B). The arm portions 32 and 33 are respectively made of rectangular tubes. The inner end of the arm portion 32, lies in the cavity 22 of the extension 21 of the bracket 14 and is there provided with a through bore 30, through which the hinge pin 29 penetrates and is secured against falling out by a schematically indicated retaining device 34 (set screw and groove) at its lower end which is located in the bore 28 (FIG. 3).

The bracket 14, in its rear region between the upper free end 16 and the extension 21, has a re-enforcing shape and contains at each of its sides a groove 35 of rectangular profile which has a curved course that is concentric with the interior curve 15 of the bracket 14. In FIGS. 2 and 3 there can be seen in each case only the groove 35 facing the observer. On the side opposite to the side visible to the observer another groove is provided in mirror image aspect.

The bracket 14 fits into a wall socket element 36 belonging to it which is shown in section in FIGS. 2 and 3. The visible section surface is a plane of symmetry. The wall socket 36 contains a groove-shaped cavity 37 which is laterally bounded by two oppositely facing side walls 38. Because of the sectional representation only one of the two side walls 38 is to be seen in FIG. 3. The two side walls 38 are spaced from each other by a distance that is somewhat greater than the thickness of the bracket 14 in the region of its groove 35, this spacing being measured in a direction parallel to the cloth-winding shaft 6. Each of the two mirror-image side walls 38 is widened by a pocket 39 at about the middle of its length, so that an upper portion 41 and a lower portion 42 will result. These upper and lower portions carry respective ribs 43 and 44 complementary to the corresponding groove 35. In the assembled state these ribs penetrate into the corresponding ribs 35. For this purpose the wall socket 36 is brought down in assembly onto the bracket 14 from above, since the upper end of the groove 35 is open.

In the assembled state a total of four ribs 43, 44 grip onto two oppositely located sides of the bracket 14 above and below in the two grooves 35. The bracket 14 is in this way simply rotatable about an axis which is concentric to the axis of revolution of the shaft 6 on which the awning cloth can be rolled-up.

In order to hold the bracket 14 in a friction grip in the wall socket 36, clamp pieces 46 are provided on the respective sides of the bracket 14 in the wall socket 36. These clamp pieces 46 are likewise of mirror image to each other and each of them is seated in one of the two cavities 39 (FIG. 3). The clamping piece 46 supports itself by its upper exteriorly located corner 47 in a rearwardly offset deepening 48 of the cavity 39. Opposite the open area which is limited by the wider-spreading surfaces 38, 42 and beyond the plane of those surfaces, the cavity 39 has a depression of such a kind that the clamping piece 46, except for a stepped extension 49 at its lower end, does not extend across the said plane. In the assembled state the extension 49 lies in the neighboring groove 35 and has a correspondingly bent shape. At the rear side of the extension 49 (towards the right in FIG. 3) there is an oblique surface 51 which cooperates with a clamping screw 52. The clamping screw is seated in a threaded bore 53 (FIG. 2) behind the side surface 42. The threaded bore 53 is provided for accepting a cylindrical head 54 of the clamping screw 52 within a deep smooth bore 55. The disposition of the wall socket element 36 in the wall bracket 5 is shown in FIG. 1A.

The free end of the portion 33 of the articulated arm 9 remote from the wall has a hinged-on holder 56 for the drop-blade 8 of the awning (FIG. 2 and 3). The holder 56 is formed (FIG. 3) of a portion 57 facing downwards in which a groove-like cavity 58 is located, which is bounded above and below by respective surfaces 59 and 61 parallel to each other and by a back wall 62. A blind threaded bore 63 leading upwards is located in the side wall 59 and is aligned flush with the stepped bore 64 disposed in the lower cavity wall 61. It serves for seating a fastening screw 65 (FIG. 2). In the assembled state the screw 65 which is screwed into the blind threaded bore 63 from below leads through corresponding bores of the arm portion 33 in which a tubular sleeve 66 is held which guides the screw 65 during assembly.

The lower portion 57 of the holder 56, above the lateral surface 59 (FIG. 3), extends into an outwardly bowed holding portion 67. The holding portion 67 has a valley channel 98 at the lower end of that position which cooperates with the drop-blade 8 of the awning in a manner described further below. It also has at its upper free end an obliquely running abutment surface 68 which has a fastening bore 69 for the insertion of a self tapping screw 71 or a blind rivet.

The drop bar of the awning, which in the case of this invention is the drop-blade 8, is likewise a one-piece sheet metal part shaped by rolling. It is composed of the following portions: an outer wall 72, an upper inner wall 73 and a lower inner wall 74.

The outer wall 72 is bent in the shape of a circular arc, i.e. it has a substantially constant radius of curvature. That radius is so dimensioned that in the rolled-up state of the awning 1, in which the drop-blade 8 lies against the awning case 2, the center of curvature of the outer wall 72 lies on the axis of the winding shaft 6. For purposes of accommodating a decorative exterior strip the outer wall 72 can be provided with a shallow depression 75 (FIG. 3) running along its entire length which is filled with a synthetic decorated stripe 76, so that over the entire outer surface the partially cylindrical shape of the drop-blade 8 is evident.

The outer wall 72, above its upper edge 76 (FIG. 3) bends over at a small bending radius to blend into the upper inner side wall 73 which continues approximately parallel to the outer wall 72, diverging from it somewhat, until it reaches a region some distance from the upper edge 76 where a hollowed groove 77 is formed which runs along the entire length of the drop-blade 8. This hollowed groove is open in the direction towards the cloth slot 11 of the awning case and in it the outer or leading edge of the awning cloth is secured in a known way, as can be seen from FIGS. 1 and 2. The hollowed groove 77 is a kind of groove used for weatherstripping and other anchoring of textile or other flexible material.

Beneath the hollowed groove 77 the inner side wall 73 of the drop-blade 8 becomes a support wall 78 (FIG. 3), which leads obliquely towards the inner side of the outer wall 72 and ends in a flange 79 which is flush against the inner side of the outer wall 72. The support wall 78 provides a plane abutment surface running parallel to the abutment surface 68 on which the drop-blade 8 can lie against the top of a suspended holder 56 which is hinged to an end of an arm 9.

The outer wall 72 at its bottom likewise folds over at a short radius of curvature at its lower edge 81 and blends into the lower inner wall 74. Close to the rim 81 the lower inner wall lies directly against the inner side of the outer wall 72 and a little above that the lower inner wall provides a hollow bead 74, which in the assembled drop-blade 8 can come to lie in the rounded groove 98 of the holder 56 when the awning is rolled-up. Thus it is sufficient to seat the holder 56 with the rounded groove 98 on the bead 74 and to wiggle it into the gap existing between the upper inner wall and the lower inner wall until it lies with its abutment surface 68 against the support wall 78. Then by inserting the securing screw 71, the holder 56 can be secured in all directions to the drop-blade 8. The bead 74 is 25 turned back flush with the portion 82 of the outer side wall 72.

The bead 72 forms, at the same time, a hollow groove open downwards for suspending a shabrack, caparison, fringe or the like.

In order to improve the sealing of the drop-blade 8 against the awning case 2 when the awning is rolled-up, a profiled seal 83 can be pushed on the upper bead-like edge 12 of the cloth slot 11 of the awning case 2. The profiled seal 83 consists of a substantially tubular portion 84 having a longitudinal slot 85 along its entire length. That slot serves for penetration by the bead-like edge 12 of the awning case 2 when the portion 84 is seated on the awning case 2. In this position, there extends upwards a ridge-like seal flange 86 which is molded integrally with the substantially tubular portion 84. Another ridge-like seal flange 87, likewise integrally molded, extends downwards from the front side of the profiled seal strip 83. As can be seen in FIG. 2, in the assembled state one flange of the tubular portion 84 of the profiled seal 83 lies between the bead-like edge 12, which extends above the outer contour of the awning case 2 and the free end 96 of the bracket 14. The securing screw 19 penetrates through the profiled seal 83.

As can be seen from the drawing figures, the cloth slot 11 of the awning case 2 is shifted quite far upwards in the illustrated awning 1. In other words, a tangential plane which contains the axis of rotation of the roll-up shaft 6 and is tangent to the upper rim 12 of the cloth slot 11, is inclined only by a small angle of about 10° to 15° to the plane which is defined by the hinge pins 29. Thus the result is obtained that the edge 12 rubs against the upper side of the awning cloth 7 only for the last centimeters of rolling up movement of the awning cloth 7, as can be seen from FIG. 2. As soon as the roll of cloth has become somewhat smaller during unrolling, the awning cloth 7 runs out of the cloth slot 11 without contact, so that the necessarily occurring hanging of the awning cloth very soon contributes to the separation of the awning cloth 7 from the slot edge 12.

Furthermore, the lower edge 13 is so far offset downwards in the awning of the present invention that even when some hanging down of the awning cloth occurs in the completely unrolled state of the awning cloth 7, which proceeds tangentially from the upper side of the shaft 6 and its unrolling cloth, does not come into contact with the lower slot edge 13. From this disposition of the slot there is produced an opening of the cloth slot 11, as seen in the circumferential direction of the awning case 2, of about 80° in circumferential angle, measured with reference to the axis of the shaft 6.

In the rolled-up state the drop-blade 8 lies with its upper inner wall 73, barely below the upper edge 96, against the seal 83, and indeed against both the almost tubular portion 84 and the seal flange 86 (see FIG. 2). The bead 74, on the other hand, lies locally on the brackets 14, and more particularly between the lower extension 21 and the opening 17 and also in the valley groove 98 of the extension 67 of the holder 56. As soon as this position is reached, the outer wall 72 provides a portion of a cylindrical surface which is coaxial with the awning case 2. The articulated arms 9 then lie essentially below the awning case 2, so that for the observer a closed overall aspect results, without the drop-blade 8 being distinctly seen on the awning case 2. That is because the outer hinges of these arms are suspended by the structures 56 from supports 78 and stabilized by supports 74 on the inside of the drop-blade 8 and are located underneath the awning case in the rolled-up state of the awning (FIG. 1B).

In order not to disturb the closed aspect of the awning 1 in its rolled-up state, the bucket-like caps 3 and 4 are equipped with their encircling flanges 88 and 89. Their diameter is preferably about twice the radius of curvature of the outer wall 72 of the drop-blade 8, so that these flanges can be externally flush with the drop-blade 8.

In that rolled-up state the drop-blade 8 provides a stripe-shaped region of the awning case 2 that covers the cloth slot 11, as seen in the lengthwise direction, and also a stripe-like region below the lower bead-like edge 13 of the slot, likewise seen in the lengthwise direction. In this manner distortions of the awning case 2 are minimized, such as tend to arise as the drop member runs up against the cloth slot, as is frequently the case in the known awnings.

Although the invention has been described with reference to a particular illustrative example, it will be recognized the variations and modifications are possible within the inventive concept.

We claim:

1. An awning having an elongated awning case (2) formed with a cloth feed slot (11) extending over the entire length of said awning case, said cloth feed slot defining an upper edge (12) and a lower edge (13);

a roll-up shaft (6) in said awning case;

an elongate awning cloth (7) fastened at a first end onto the roll-up shaft (6);

an elongate rigid drop member (8) secured to a second end of said awning cloth, remote from the first end thereof and extending across the width of said awning cloth;

a plurality of wall-attachable holding brackets (5) for attaching said awning case (2) to a wall;

articulated arms (9, 32, 33) coupled at first ends thereof to said drop member (8); and hinge means (29) defining parallel hinge axes pivotably connecting second ends of said arms (9, 32, 33) to said wall-attachable holding brackets (5), to permit swinging movement of said arms about parallel axes at said respective wall attachable holding brackets; and wherein, when the awning is closed and the awning cloth (7) is retained in said awning case (2), the drop member (8) covers the cloth feed slot (11);

the drop member (8) overlaps the upper edge (12) and the lower edge (13) of said cloth feed slot (11); and the hinge means (29) are located below the awning case, and the articulated arms (9, 32, 33), when the awning is closed, are folded beneath the awning case (2).

2. The awning of claim 1, wherein said upper and lower edges (12, 13) of said cloth feed slot (11) in the awning case (2) are separated from each other by a spacing corresponding to the chord of an angle of at least 60°, which angle has its apex on a axis of revolution of said roll-up shaft (6); and wherein one leg of said angle has an angular position with respect to a plane passing through the pivot axes of said hinge means by an offset of not more than 15°, in the direction of the drop member.

3. The awning of claim 2, wherein said leg is offset with respect to the plane passing through the pivot axes of said hinge means by less than 10°, in the direction of the drop member (8).

4. The awning of claim 1, wherein said awning case (2) is of part essentially circular cross-section; and said drop member (8) has a part circular cross-section, the radius of curvature of which is greater than the radius of curvature of said awning case (2).

5. The awning of claim 4, wherein, when said awning is closed and the awning cloth (7) is retained in the awning case (2), the center of curvature of said drop member (8) is positioned on the axis of revolution of said roll-up shaft (6).

6. The awning of claim 1, wherein the outside shape of said awning case (2) is essentially cylindrically smooth.

7. The awning of claim 1, wherein said awning case (2) comprises a longitudinally slotted tube; and bucket-like caps (3, 4) are provided, mounted on the ends of said tube.

8. The awning of claim 7, wherein said awning case (2) is of part essentially circular cross section;

said drop member (8) has a part-circular cross section; and said bucket-like caps (3, 4) have a diameter which is twice as large as the radius of said circular cross-section of the drop member (8), whereby, in the rolled-up state of said awning, said drop member is, externally, substantially flush with said bucket-like caps.

9. The awning of claim 1, wherein said edges (12, 13) of said cloth feed slot in the awning case (2) are formed with bead-like reinforcements.

10. The awning of claim 1, wherein said drop member (8) is, essentially, a shaped sheet metal structure.

11. The awning of claim 1, wherein said awning case (2) is essentially a shaped sheet metal structure.

12. The awning of claim 1, wherein said drop member (8) substantially is of formed sheet metal; and said awning case (2) substantially is of formed sheet metal.

13. The awning of claim 1, wherein said brackets (5) comprise a bracket body and a bracket element (14) attachably connected to said bracket body (5), said bracket element fitting, at least in part, around said awning case (2).

14. The awning of claim 13, wherein said hinge means (27) are secured to said bracket element (14) and positioned within a vertical projection of said awning case (2).

15. The awning of claim 1, further including a sealing element (83) positioned adjacent the upper edge (12) and engageable, when the awning is closed with the awning cloth (7) retained in the awning case (2), against an upper edge of the drop member (8) for sealing the slot (11) against the drop member (8) to prevent ingress of moisture into the awning case.

16. The awning of claim 2, wherein said drop member (8) substantially is of formed sheet metal; and said awning case (2) substantially is of formed sheet metal.

17. The awning of claim 5, wherein said drop member (8) substantially is of formed sheet metal; and said awning case (2) substantially is of formed sheet metal.

18. The awning of claim 6, wherein said drop member (8) substantially is of formed sheet metal; and said awning case (2) substantially is of formed sheet metal.

19. The awning of claim 7, wherein said drop blade (8) substantially is of formed sheet metal; and said awning case (2) substantially is of formed sheet metal.

20. The awning of claim 7, including bearing means for said roll-up shaft positioned in the interior of said bucket-like caps.

* * * * *